US006360510B1

(12) United States Patent
Woodrum et al.

(10) Patent No.: US 6,360,510 B1
(45) Date of Patent: Mar. 26, 2002

(54) HAT-CHANNEL STUD FOR MODULAR BUILDING SYSTEM

(75) Inventors: Trace A. Woodrum, Ballwin; Wayne R. McGee, Chesterfield, both of MO (US)

(73) Assignee: Porta-Fab Corporation, Chesterfield, MO (US)

( * ) Notice: Subject to any disclaimer, the term of this patent is extended or adjusted under 35 U.S.C. 154(b) by 0 days.

(21) Appl. No.: 09/218,699

(22) Filed: Dec. 22, 1998

(51) Int. Cl.[7] ..... E04C 3/32

(52) U.S. Cl. ..... 52/731.1; 52/731.9; 52/731.4; 52/731.5; 52/730.6; 52/729.5; 52/729.2; 52/770; 52/36

(58) Field of Search ..... 52/729.2, 729.5, 52/730.6, 731.5, 731.4, 731.9, 731.1, 770

(56) References Cited

U.S. PATENT DOCUMENTS

| | | | | | |
|---|---|---|---|---|---|
| 1,927,442 | A | * | 9/1933 | Laufle | 52/729.2 |
| RE21,921 | E | * | 10/1941 | Greulich | 52/729.2 |
| 2,817,422 | A | * | 12/1957 | Solomon | 189/34 |
| 3,043,408 | A | * | 7/1962 | Attwood | 189/34 |
| 3,407,547 | A | * | 10/1968 | Doke et al. | 52/36 |
| 3,483,665 | A | * | 12/1969 | Miller | 52/461 |
| 4,839,999 | A | * | 6/1989 | Clemens et al. | 52/36 |
| 5,287,675 | A | * | 2/1994 | McGee | 52/731.9 |

OTHER PUBLICATIONS

Brochure "Modular In–Plant Buildings: An investment in your company's future", p. 14.

* cited by examiner

*Primary Examiner*—Carl D. Friedman
*Assistant Examiner*—Christy M. Syres
(74) *Attorney, Agent, or Firm*—Howell & Haferkamp LC

(57) ABSTRACT

A stud for a modular building system. The stud comprises two elongate channel members secured together, with each of the channel members have a generally hat-shaped cross section. The channel members each have a bottom web, and a first and second side web. the side webs extend perpendicularly and upward from opposite sides of the bottom web. The channel members further comprise a first and second flange that extend laterally from the first and second side webs respectively. In one aspect of the invention, each flange comprises a first segment extending generally laterally outward from the upper edge of its respective side web and a second segment folded back upon the first segment and extending back toward the side web. In another aspect of the invention, the second segment overlaps and overlies the underside of the first segment, and the fold or crease between the first and second segments, has a rounded profile and forms a bead at the edge of each flange. The first and second elongate channel members when secured together at their bottom webs form the elongate stud and provide oppositely facing slots for receiving wall panels. Covers can be provided for the elongate channel members. In a second embodiment of the invention, the channel members and the covers include off-sets providing a snap fit.

21 Claims, 4 Drawing Sheets

HAT-CHANNEL STUD FOR MODULAR BUILDING SYSTEM

FIELD OF THE INVENTION

This invention is directed to the field of studs for modular building systems, and more particularly to studs for such building systems. The invention is particularly related to such a stud having structural superiority and increased load carrying capacity.

BACKGROUND OF THE INVENTION

Generally, studs for modular building systems have elongate channel members with hat-shaped cross-sections. The elongate channel members each comprise a bottom web and two side webs attached to the bottom web that extend upwardly from the bottom web. There is a flange extending laterally outward from the top of each side web. Two of these elongate channel members are secured together at their bottom webs, facing oppositely, to form a stud. The elongate channel members are normally secured together with a bolt or screw or a similar fastener. The flanges on each side of the stud form a groove for receiving wall panels.

Generally C-shaped channel members can be inserted in the channels of the channel members forming the stud. This generally provides a more finished appearance, as the C-shaped channel members cover the fasteners that connect the two elongate channel members.

While existing studs provide adequate strength for many modular building system applications, there are situations where it would be desirable to provide stronger studs. For example, where a modular building will have a second floor, or where the roof will be used for storage, stronger studs would better support such loads. Existing studs have slots for receiving wall panels, and the sharp edges of the slots can scrape the wall panels as they are inserted into the slots.

SUMMARY OF THE INVENTION

The stud of the present invention is particularly adapted for use in modular building systems. Generally, the stud comprises a first elongate channel member and a second elongate channel member. The two elongate channel members are secured together, facing oppositely, at their bottom webs, with slots formed on each side by a flange on each of the elongate channel members. The slots are oppositely facing and receive wall panels or the like.

Each channel member has a generally hat-shaped cross-section comprising a bottom web and side web extending generally perpendicularly and upwardly from each side of the bottom web. A flange extends generally laterally outward from the top of each of the side webs. Each of the flanges comprises a first segment extending outwardly from its respective side web and a second segment folded back upon the first segment. The fold or crease between these two segments preferably has a rounded profile and forms a bead at the edge of each of the flanges.

A generally C-shaped channel member can be inserted into the elongate channel member, between its side webs. The C-shaped channel member covers the opening between the two side webs of the elongate channel member biding the fasteners connecting the elongate channel members to one another.

The stud of the present invention provides significantly increased load carrying capacity without changing the overall size and shape of the stud. The stud of the present invention has a flange with a section folded back on itself which provides increased strength without a substantial increase in cost or weight. Moreover, the flanges of the stud have a rounded profile and a bead at the edge of each flange, which minimizes scratching or other damage to wall panels inserted into the slots of the stud. The elongate channel members of the stud may also include side webs with off-sets that further increase the strength of the stud and reduce bending of the side webs. Additionally, the generally C-shaped channel members can have corresponding off-sets in its side webs to interfit with the off-sets in the side webs of the elongate channel members. This provides a snap-fit that helps retain the C-shaped channel members in the elongate channel members.

These and other features and advantages will be in part apparent, and in part pointed out hereinafter.

BRIEF DESCRIPTION OF THE DRAWINGS

Corresponding reference numerals indicate corresponding parts throughout the several views of the drawings.

DETAILED DESCRIPTION OF PREFERRED EMBODIMENTS

Figure 4:
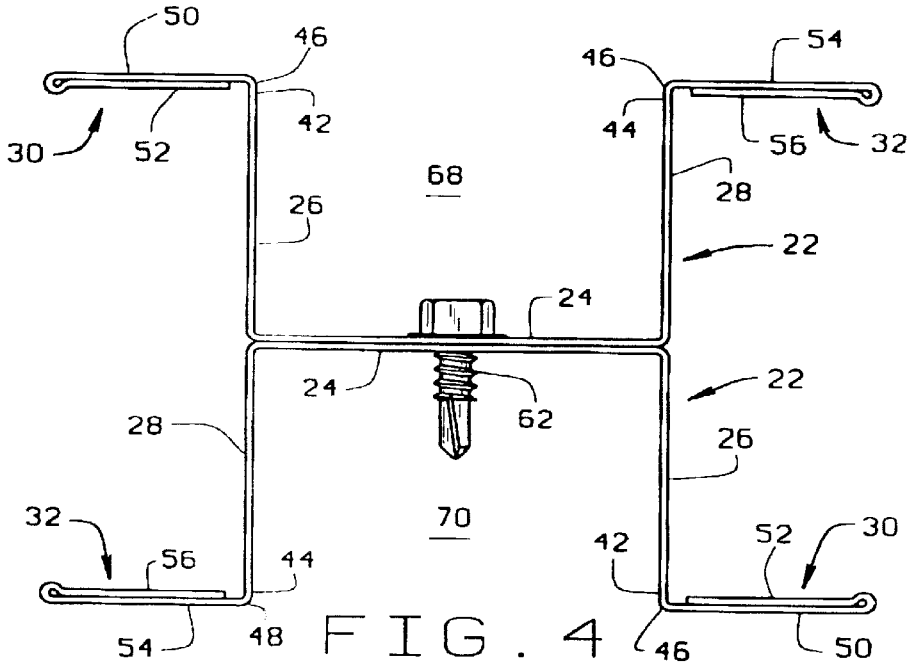
FIG. 4 is an end view of a stud constructed according to the principles of the present invention.
Figure 5:
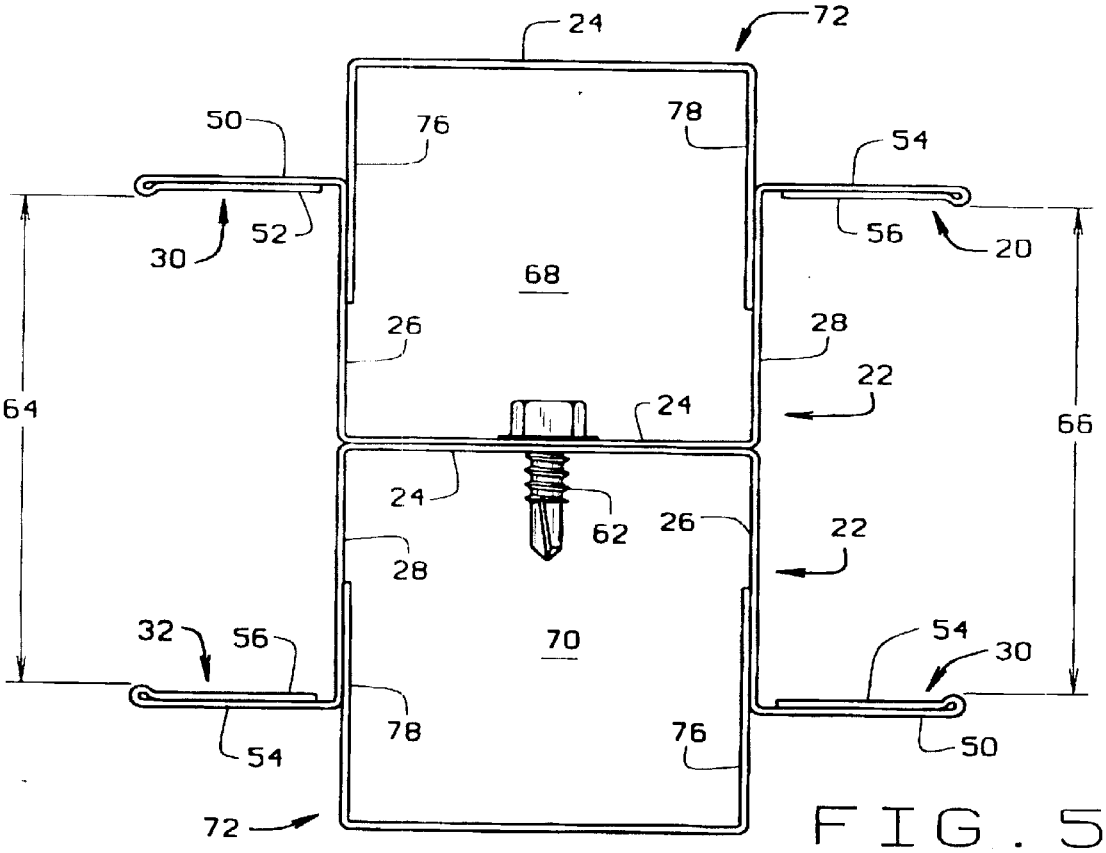
FIG. 5 is an end view of the stud with the C-shaped channel cover partially inserted therein.
Figure 6:
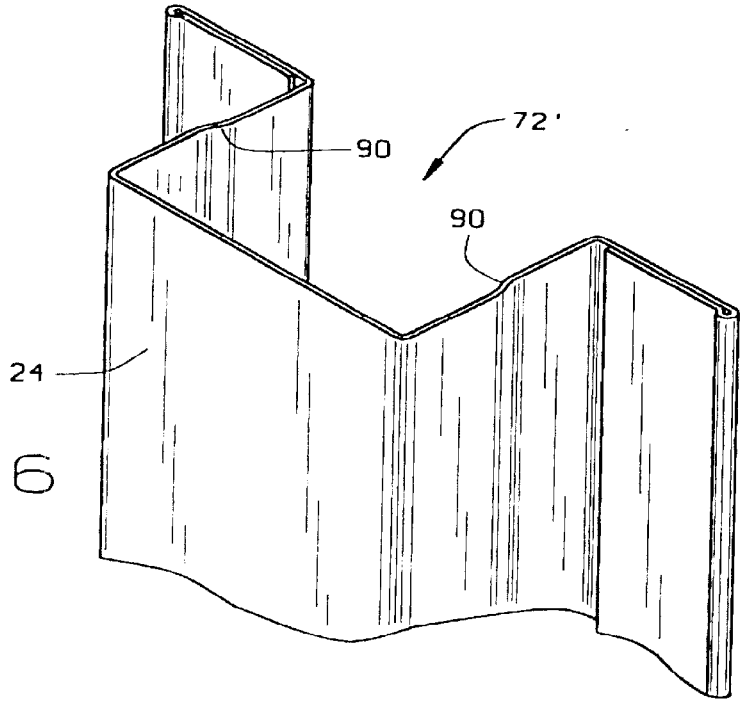
FIG. 6 is a perspective view of a second embodiment of the elongate channel member used to form the stud of the present invention.

A stud constructed according to the principles of the present invention, adapted for use in modular building systems, is indicated generally as 20 in FIGS. 4 and 5. The stud 20 comprises two identical elongate channel members 22 secured together. The elongate channel members 22 include a bottom web 24, a first side web 26, a second side web 28, a first flange 30, and a second flange 32.

The bottom web 24 is generally flat and has a first side edge 34 and a second side edge 36. The first side web 26 extends generally perpendicularly upwardly from the first side 34 of the bottom web 24. The second side web 28 extends generally perpendicularly upwardly from the second side 36 of the bottom web 24. The comer 38 formed by the bottom web 24 and the first side web 26 and the comer 40 formed by the bottom web and the second side web 28 have generally rounded edges.

The first flange 30 extends generally laterally outwardly from the top edge 42 of the first side web 26. The second flange 32 extends generally laterally outwardly from the top edge 44 of the second side web 28. The comer 46 formed by the first side web 26 and the first flange 30, and the corner 48 formed by the second side web 28 and the second flange 32, have rounded edges. Each of the first side web 26, the second side web 28, the first flange 30, and the second flange 32 are generally flat.

Figure 1:
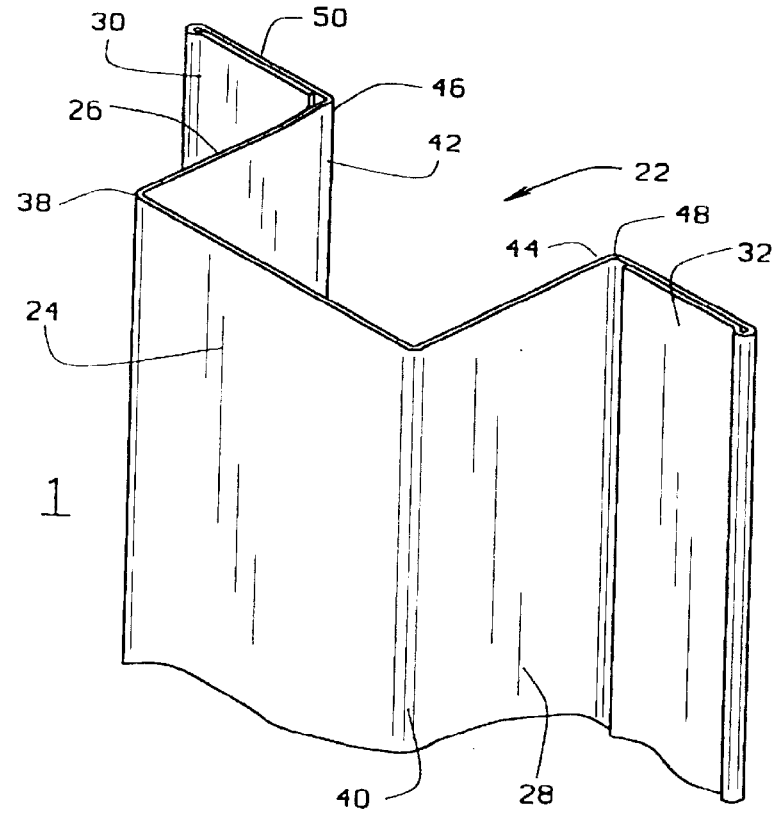
FIG. 1 is a perspective view of the elongate channel member used to form the stud of the present invention.
Figure 2:
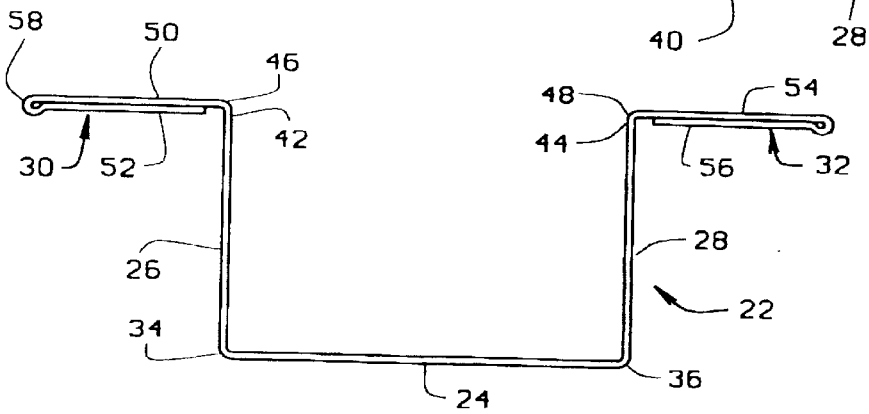
FIG. 2 is an end view of the elongate channel member.
Figure 3:
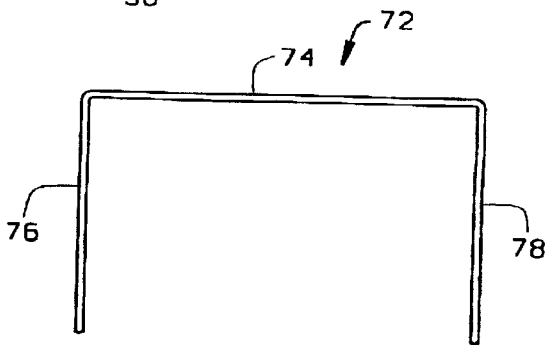
FIG. 3 is an end view of the C-shaped channel member used to cover the open channels in the channel members forming the stud of the present invention.

As shown in FIG. 2, the first flange 30 comprises a first segment 50 extending generally outwardly from the top edge 42 of the first side web 26. The first flange 30 further comprises a second segment 52 folded back upon the first segment 50. The second flange 32 comprises a first segment 54, extending generally outwardly from the top edge 44 of the second side web 28. The second flange 32 further comprises a second segment 56 folded back upon the first segment 54 of the second flange. The second segment 52 and the second segment 56 overlap or overlie the underside of the first segments 50 and 54 of their respective flanges. The second segments 52 and 56 substantially overlap the entire lateral width of their respective first segments 50 and 54.

The fold or crease 58 between the first segment 50 and the second segment 52, and the fold or crease 60 between the first segment 54 and the second segment 56, have rounded profiles forming smooth beads, generally facing downwardly.

As shown in FIG. 4, the two elongate channel members 22 are joined together to form a stud 20. The channel members 22 are arranged facing in opposite directions and their bottom webs 24 arce secured together with fasteners 62. The fasteners 62 are preferably screws, although they could be some other fastening means such as bolts and nuts or spot welding. The stud 20 has oppositely facing slots 64 and 66 on opposite sides thereof formed by the first and second flanges 30 and 32 of the two elongate channel members. The slots 64 and 66 are adapted to receive wall panels from the modular building system. The beads on the flanges 30 and 32 of the elongate channel members provide smooth surfaces to prevent damage to wall panels inserted into the slots 64 and 66, and to engage wall panels inserted into the slots.

The channels of the elongate channel members 22 forming the studs are open, forming elongate openings 68 and 70 on the front and back of the stud 20, in which the fasteners 62 are visible. As shown in FIG. 5, covers 72 can be provided for the elongate opening s 68 and 70. the covers 72 are preferably elongate C-shaped channel members comprising a bottom web 74, and first and second side webs 76 and 78 extending perpendicularly from the side edges of the bottom web. The covers 72 are adapted to fit inside the elongate openings 68 and 70. The wide that side webs 76 and 78 of the covers 72 correspond to the of the openings 68 and 70, so that the bottom web 74 of the cover is generally flush with flanges 30 and 32 of the channel member in which it is installed, providing a smooth finished appearance for the front and back of the stud, and hiding the fasteners 62.

The cover 72 fits snuggly in the openings 68 and 70, and is held in place by friction, without the need for fasteners. FIG. 5 shows the covers 72 being inserted into the openings 68 and 70.

Figure 9:
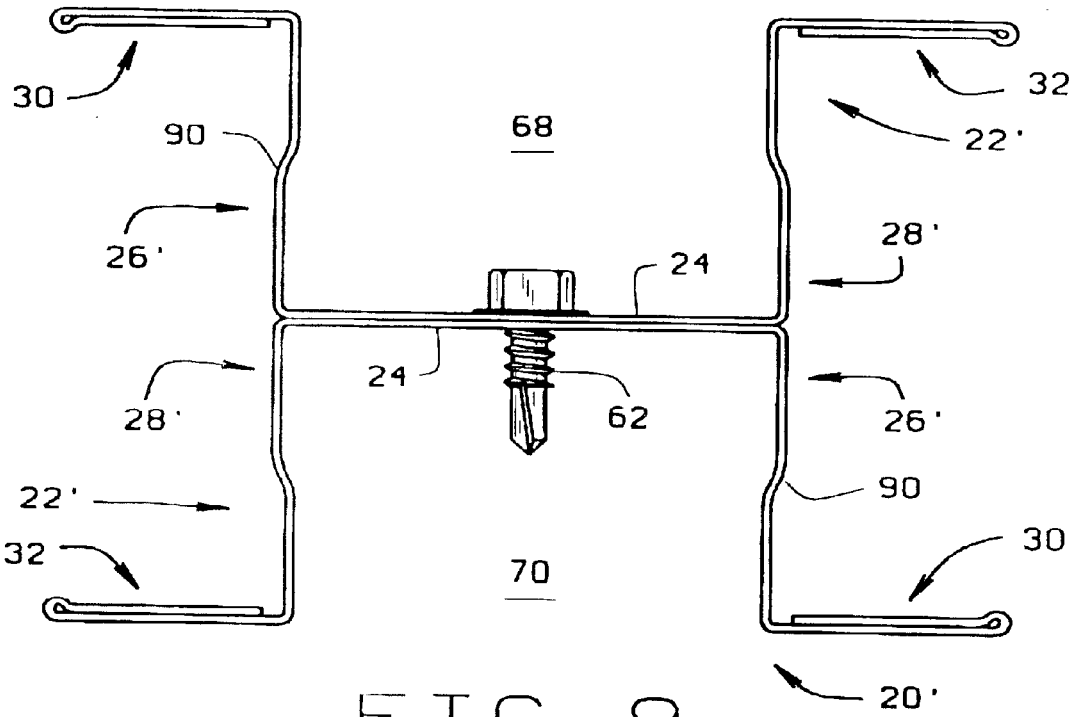
FIG. 9 is an end view of a second embodiment of the stud constructed according to the principles of the present invention.
Figure 10:
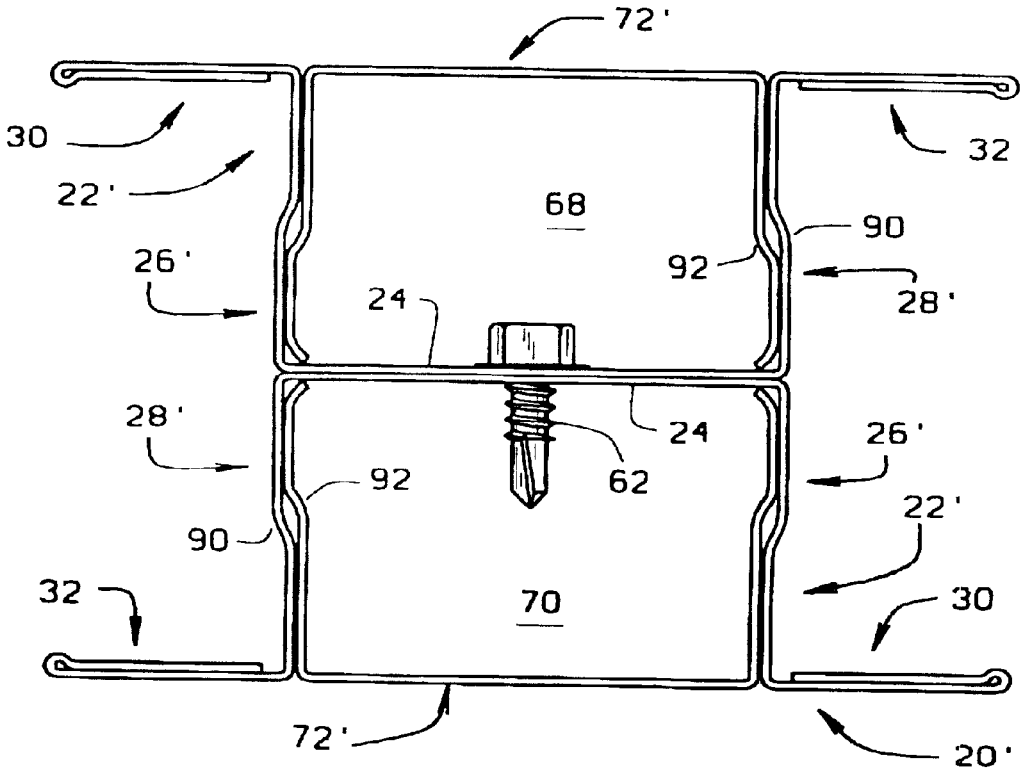
FIG. 10 is an end view of the second embodiment of the stud with the C-shaped channel cover partially inserted therein.

A second embodiment of a stud constructed according to the principles of the present invention, adapted for use in modular building systems, is indicated generally as 20' in FIGS. 9 and 10. The stud 20' is similar in construction to stud 20, and corresponding parts are identified with corresponding reference numbers. The stud 20' comprises two identical elongate channel members 22' secured together. The elongate channel members 22' include a bottom web 24, a first side web 26', a second side web 28', a first flange 30, and a second flange 32.

Figure 7:
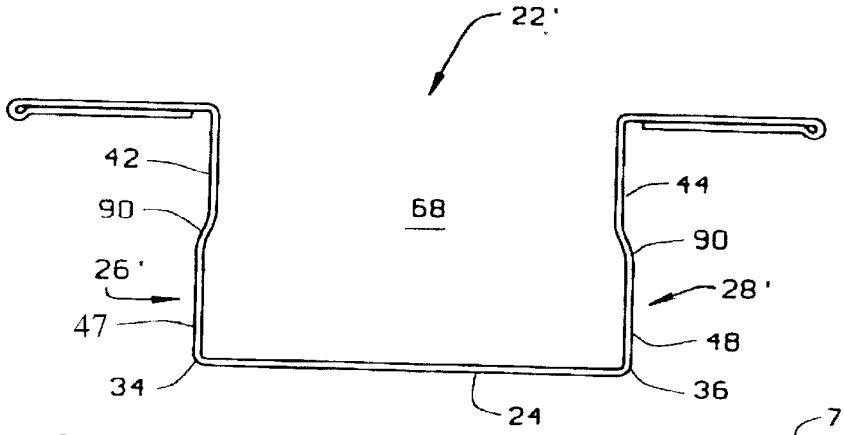
FIG. 7 is an end view of the second embodiment of the elongate channel member.

In this second embodiment, as shown in FIG. 7, the bottom web 24 is generally flat and has a first side edge 34 and a second side edge 36. The first side web 26' extends generally perpendicularly upwardly from the first side edge 34 of the bottom web 24. The second side web 28' extends generally perpendicularly upwardly from the second side edge 36 of the bottom web 24. In this second embodiment, the first side web 26' and the second side web 28' each include an off-set 90. The off-set provides a more narrow opening 68 between the upper section 42 of the first side web 26' and the upper section 44 of the second side web 28' than between the lower sections 47 and 49 of the side webs adjacent to the bottom web 24.

Figure 8:
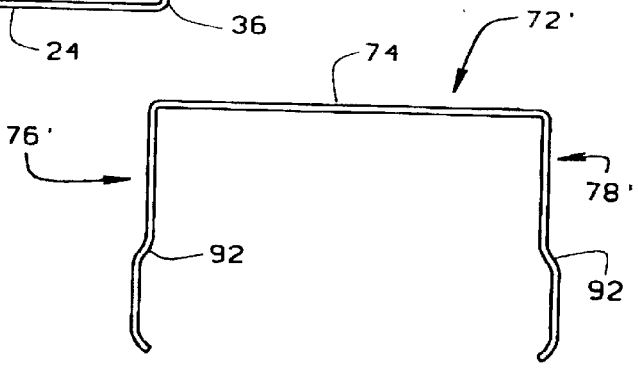
FIG. 8 is an end view of a second embodiment of the C-shaped channel member used to cover the open channels in the channel members forming the stud of the present invention.

As shown in FIG. 9, the two elongate channel members 22' are joined together to form a stud 20'. The channel members 22' are arranged facing in opposite directions and their bottom webs 24 are secured together with fasteners 62. The channels of the elongate channel members 22' forming the studs are open, forming elongate openings 68 and 70 on the front and back of the stud 20', in which the fasteners 62 are visible. As shown in FIG. 10, covers 72' can be provided for the elongate openings 68 and 70. The covers 72' are preferably elongate C-shaped channel members comprising a bottom web 74, and first and second side webs 76' and 78' extending perpendicularly from the side edges of the bottom web as shown in FIG. 8. The side webs 76' and 78' of the covers 72' are provided each with corresponding off-sets 92, such that when the covers are inserted in the openings 68 and 70, the off-sets 90 and the off-sets 92 provide a snap-fit that secures the covers in the elongate channel members 22' between their side webs. The cover 72' fits tightly in the openings 68 and 70, and is held in place by the off-sets, providing a smooth, attractive finish. FIG. 10 shows the covers 72' being inserted into the openings 68 and 70.

With all these embodiments, the elongate channel members and the C-shaped channel members are preferably roll formed with a suitable metal such as steel. This metal may be prepainted if desired.

OPERATION

The stud 20 is assembled by taking two elongate channel members 22, arranging them to face oppositely with their bottom web members 24 touching. Fasteners 62 are driven through the bottom webs 24 to secure the channel members 22 together. The covers 72 can then be secured in the openings 68 and 70. This gives the front and back of the stud a smooth, finished appearance and hides the fasteners 62. The studs 20 are ready to be used in modular building systems.

Similarly, the stud 20' is assembled by taking two elongate channel members 22', arranging them to face oppositely with their bottom web members 24 touching. Fasteners 62 are driven through the bottom webs 24 to secure the channel members 22' together. The covers 72' can then be secured in the openings 68 and 70. This gives the front and back of the stud 20' a smooth, finished appearance and hides the fasteners 62. The studs 20' are ready to be used in modular building systems.

Panels can be inserted into the slots 64 and 66 of the stud 20 or 20'. The bead on the flanges 30 and 32 that form the slots provide a smooth surface reducing the risk of damage to the panels. The beads on the opposing flanges forming the slots 64 and 66 also help engage and seal with the panels inserted into the slots. The new construction of the flanges strengthens the stud 20 or 20', allowing the studs to support greater loads without substantial changes in its configuration or weight.

While the present invention has been described by reference to specific embodiments in the drawings, it should be understood that modifications and variations of the invention may be constructed without departing from the scope of the invention defined in the following claims.

What is claimed is:

1. A stud for a modular building system, the stud comprising:

first and second elongate channel members secured together, each channel member having a generally hat-shaped cross-section with a bottom web, and first and second side webs extending perpendicularly upwardly from opposite sides of the bottom web, and first and second flanges extending generally laterally outwardly from the first and second side webs, respectively, each flange comprising a first segment extending outwardly from the upper edge of its respective side web wherein the first segments extend away from each other, and a second segment folded back upon the first segment and extending toward the side web; and the first and second channel members facing oppositely and secured together at their bottom webs.

2. The stud according to claim 1 wherein the second segment of the flanges overlaps substantially laterally the entire first segment.

3. The stud according to claim 2 wherein the second segment of the flanges overlies the underside of the first segment.

4. A stud for a modular building system, the stud comprising:

first and second elongate channel members secured together, each channel member having a generally hat-shaped cross-section with a bottom web, and first and second side webs extending perpendicularly upwardly from opposite sides of the bottom web, and first and second flanges extending generally laterally outwardly from the first and second side webs, respectively, each flange comprising a first segment extending outwardly from the upper edge of its respective side web, and a second segment folded back upon the first segment and extending toward the side web, the second segment of the flanges overlapping substantially laterally the entire first segment, the second segment of the flanges overlies the underside of the first segment;

the first and second channel members facing oppositely and secured together at their bottom webs; and wherein a fold or crease between the first and second segments has a rounded profile and forming a bead at the edge of each flange.

5. The stud according to claim 1 wherein the second segment of the flanges is folded over and overlaps the underside of the first segment.

6. A stud for a modular building system, the stud comprising:

first and second elongate channel members secured together, each channel member having a generally hat-shaped cross-section with a bottom web, and first and second side webs extending perpendicularly upwardly from opposite sides of the bottom web, and first and second flanges extending generally laterally outwardly from the first and second side webs, respectively, each flange comprising a first segment extending outwardly from the upper edge of its respective side web, and a second segment folded back upon the first segment and extending toward the side web;

the first and second channel members facing oppositely and secured together at their bottom webs; and a generally C-shaped channel member in each of the hat-shaped elongate channel members.

7. The stud according to claim 1 wherein the first side web and the second side web each further comprise an off-set.

8. A stud for a modular building system, the stud comprising:

first and second elongate channel members secured together, each channel member having a generally hat-shaped cross-section with a bottom web, and first and second side webs extending perpendicularly upwardly from opposite sides of the bottom web, and first and second flanges extending generally laterally outwardly from the first and second side webs, respectively, each flange comprising a first segment extending outwardly from the upper edge of its respective side web, and a second segment folded back upon the first segment and extending toward the side web, the first side web and the second side web each further comprising an off-set;

the first and second channel members facing oppositely and secured together at their bottom webs; and a generally C-shaped channel member in each of the hat-shaped elongate channel members, each C-shaped channel member further comprising a bottom and opposing side webs, each side web having an off-set therein shaped to interfit with the off-sets in the first and second side webs of the first and second elongate channel members.

9. A stud for a modular building system, the stud comprising:

first and second elongate channel members secured together to form an elongate stud with oppositely facing slots for receiving wall panels;

each elongate channel member having a generally hat-shaped cross-section with a bottom web having first and second sides, first and second side webs extending generally perpendicularly upwardly from the first and second sides of the bottom web, respectively, a first flange extending generally laterally outwardly from the top of the first side web, and a second flange extending generally laterally outwardly from the top of the second side web, each of the flanges comprising a first segment extending outwardly from its respective side web, and a second segment folded back upon the first segment, the fold between the first and second segments having a rounded profile forming a continuous bead at the edge of the flange; and the first and second elongate channel members facing oppositely with their bottom webs secured together, with the slots being formed by a flange on each of the channel members.

10. The stud according to claim 9 wherein the second segment of the flanges overlaps substantially laterally the entire first segment.

11. The stud according to claim 10 wherein the second segment of the flanges is folded over and overlies the underside of the first segment.

12. The stud according to claim 9 further comprises a generally C-shaped channel member in each of the hat-shaped elongate channel members.

13. The stud according to claim 9 wherein the first side web and the second side web of each elongate channel member has an off-set therein.

14. The stud according to claim 13 further comprises a generally C-shaped channel member in each of the elongate channel members, the C-shaped channel member comprises a bottom web and opposing side webs, each of the side webs having an off-set therein shaped to interfit with the off-sets in the first and second side webs of the elongate channel members.

15. The stud according to claim 9 wherein the first and second elongate channel members facing oppositely and secured together at their bottom webs.

16. A stud for a modular building system, the stud comprising:

first and second elongate channel members facing oppositely and secured together to form an elongate stud with oppositely facing slots for receiving wall panels;

each elongate channel member having a generally hat-shaped cross-section comprising a bottom web having first and second sides, first and second side webs extending generally perpendicularly upwardly from the first and second sides of the bottom web, respectively, a first flange extending generally laterally outwardly from the top of the first side web, and generally perpendicular to the first side web, and a second flange extending generally laterally outwardly from the top of the second side web, and generally perpendicular to the second side web, each of the flanges comprising a first segment extending outwardly from its respective side web, and a second segment folded back upon and overlying the first segment, the fold or crease between the first and second segments having a rounded profile and forming a continuous bead at the edge of the flange;

the first and second elongate channel members secured together at their bottom webs, with the slots being formed by a flange on each of the channel members; and a generally C-shaped channel member in each of the hat-shaped channel members.

17. The stud according to claim 16 wherein the second segment of the flanges overlaps substantially laterally the entire first segment.

18. The stud according to claim 16 wherein the C-shaped channel member is removably connected to interior walls of the side webs of each of the elongate channel members.

19. The stud according to claim 16 wherein the first side web and the second side web each further comprise an off-set.

20. The stud according to claim 16 wherein the C-shaped channel member further comprises a top web with the C-shaped channel member substantially within each of the hat-shaped elongate channel members and the top web of the C-shaped channel member and the first and second flanges forming a generally flat surface.

21. The stud according to claim 20 further comprises a generally C-shaped channel member in each of the elongate channel members, the C-shaped channel member comprises a bottom web and opposing side webs, each of the side webs having an off-set therein shaped to interfit with the off-sets in the first and second side webs of the elongate channel members.

* * * * *